US008718520B2

(12) United States Patent
Kubo et al.

(10) Patent No.: US 8,718,520 B2
(45) Date of Patent: May 6, 2014

(54) INTERMEDIATE TRANSFER BELT AND IMAGE FORMING APPARATUS

(75) Inventors: Hidetaka Kubo, Kanagawa (JP); Jun Aoto, Kanagawa (JP); Kenichi Mashiko, Kanagawa (JP); Sayaka Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 157 days.

(21) Appl. No.: 13/528,287

(22) Filed: Jun. 20, 2012

(65) Prior Publication Data

US 2013/0004212 A1 Jan. 3, 2013

(30) Foreign Application Priority Data

Jul. 1, 2011 (JP) ..... 2011-147241
May 2, 2012 (JP) ..... 2012-105331

(51) Int. Cl.
*G03G 15/01* (2006.01)

(52) U.S. Cl.
USPC ..... 399/302; 399/308

(58) Field of Classification Search
USPC ..... 399/162, 302, 308
See application file for complete search history.

(56) References Cited

U.S. PATENT DOCUMENTS 7,266,333 B2 * 9/2007 Hara ..... 399/302
8,521,073 B2 * 8/2013 Kubo et al. ..... 399/302
2012/0082488 A1 4/2012 Kubo et al.

FOREIGN PATENT DOCUMENTS

JP 2005-309181 11/2005
JP 4396959 10/2009
JP 2012-78598 4/2012

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

To provide an intermediate transfer belt, which contains a base layer, and an elastic layer formed on the base layer, wherein the base layer contains polyimide which has a constitutional unit derived from pyromellitic acid and a constitutional unit derived from diaminodiphenyl ether, wherein the intermediate layer has a curling amount of 1.5 mm or less in an absolute value, and wherein the intermediate transfer belt is configured to receive, by transferring, a toner image formed by developing, with a toner, a latent image formed on an image bearing member.

15 Claims, 2 Drawing Sheets

INTERMEDIATE TRANSFER BELT AND IMAGE FORMING APPARATUS

BACKGROUND OF THE INVENTION

1. Field of the Invention

The present invention relates to an intermediate transfer belt, and to an image forming apparatus using the intermediate transfer belt.

2. Description of the Related Art

In the conventional art, a belt, especially a seamless belt, has been used for various purpose, as a member in an electrophotographic image forming apparatus. In recent years, an intermediate transfer belt system has been used in a full color image forming apparatus, where the intermediate transfer belt system includes superimposing developed images of four colors, yellow, magenta, cyan, and black temporarily on an intermediate transfer member, and collectively transferring the superimposed images onto a transfer medium, such as paper.

As for the aforementioned intermediate transfer belt, a system using developing units of four respective colors to one photoconductor has been used, but this system has a problem that a printing speed thereof is slow. Accordingly, to achieve high speed printing, a quarto-tandem system has been used, where the tandem system includes providing photoconductors of four respective colors, and an image of each color is continuously transferred to paper.

In this system, however, it is very difficult to accurately position images of colors to be superimposed, as the paper is affected by the fluctuations of the environment, which causing displacement of the colors in the image.

Accordingly, currently, an intermediate transfer belt system has been mainly adapted for the quarto-tandem system.

Under the circumstances as mentioned above, the higher requirements for properties (high speed transferring, and accuracy for positioning) of a intermediate transfer belt have been demanded than before, and therefore it is necessary for an intermediate transfer belt to satisfy these requirements. Especially for the accuracy for positioning, it has been required to inhibit variations caused by deformation of an intermediate transfer belt itself, such as stretching, after continuous use thereof. Moreover, an intermediate transfer belt is desired to have flame resistance as it is provided over a wide region of a device, and high voltage is applied thereto for transferring. To satisfy these demands, a polyimide resin, polyamideimide resin, or the like, that is a highly elastic and highly heat resistant resin, has been mainly used as a material of an intermediate transfer belt.

An intermediate transfer belt formed of a polyimide resin is however has high surface hardness, as the resin constituting the belt has high hardness. When a toner image is transferred, therefore, high pressure is applied to a toner layer. As a result, the toner is partially aggregated, and formation of so-called a partially-missing image, where part of an image is not transferred, may be caused. Moreover, the intermediate transfer belt having high hardness has inferior correspondence to a member to be in contact in a transferring section, such as with a photoconductor or a sheet. Accordingly, a contact failed area (void) may be partially caused in the transferring section, causing transfer unevenness.

In addition, there have been recently more occasions that images are formed on various types of a sheet in a full-color electrophotographic system. Not only a general smooth sheet, various sheets from a sheet of high smoothness with slippy surface, such as coated paper to a sheet having surface roughness, such as recycle paper, embossed paper, Japanese paper, and Kraft paper, have been often used. It is important that an intermediate transfer belt has correspondence to sheets of these different surface configurations. If the intermediate transfer belt has insufficient correspondence, unevenness in density and color tone corresponded to the convexoconcave surface configurations of the sheet appears in the resulting image. To solve this problem, various intermediate transfer belts have been proposed to laminate a relatively flexible layer onto a base layer.

When the relatively flexible layer (elastic layer) is used as a surface layer, however, transfer pressure reduces, and correspondence to surface irregularities of a sheet improves, but a toner may not be desirably released from an intermediate transfer belt because of insufficient releasing properties of a surface of the belt, which reduces transfer efficiency, and cannot effectively utilize the aforementioned effects. Moreover, such intermediate transfer belt also has problems that it has low abrasion resistance and excoriation resistance.

The aforementioned elastic layer is often designed to be the thicker film than a base layer to give an effect of providing correspondence to surface irregularities. A flexible material called an elastic layer generally has greater heat expansion coefficient than that of a base layer formed of polyimide or the like. Therefore, the resulting belt significantly curls outwards. When such belt is mounted in an image forming apparatus, running failures and cleaning failures tend to be caused.

To solve the aforementioned problem, there is disclosed an intermediate transfer belt, in which materials each having different heat expansion coefficient are laminated, a member for inhibiting curling is incorporated in the edge of the belt curled outwards (see Japanese Patent Application Laid Open (JP-A) No. 2005-309181). The disclosed belt however tends to be abraded by contact with the inhibiting member, and moreover the transfer pressure tends to varied between a center part and edge part of the intermediate transfer belt to thereby cause variations in a transfer performance. Therefore, the belt cannot provide images of high quality level of which is demanded for the current image forming apparatus.

There has been also disclosed a semiconductor belt containing an outer layer and inner layer both of which are mainly formed of a polyimide resin, where a difference in linear expansion coefficient between the outer layer and the inner layer is 30 ppm/° C. or lower (see Japanese Patent (JP-B) No. 4396959). The disclosed belt exhibits an effect of reducing a curling amount when the thickness thereof is approximately up to 200 μm, but it is difficult to control the curling amount when the thickness thereof is 200 μm or greater.

Particularly in the recent trends, a size of a device has been increased corresponded to the increase in the speed of printing, e.g., sheets per unit time, of an image forming apparatus. Accordingly, as for an intermediate transfer belt, a belt having a long peripheral length is desired.

Such intermediate transfer belt has a large degree of thermal shrinkage compared to the conventional intermediate transfer belt, and therefore edge parts of the intermediate transfer belt are more easily curled. As a result, there is a problem that the edge parts of the belt are easily damaged.

Accordingly, it is currently desired to provide an intermediate transfer belt capable of forming high quality images, having excellent durability without causing paper jamming due to the curl of the belt and forming uneven images, and having excellent cleaning properties.

SUMMARY OF THE INVENTION

The present invention aims to solve the aforementioned various problems in the art, and to achieve the following object. An object of the present invention is to provide an intermediate transfer belt, which can provide high quality images, has excellent service durability without causing paper jamming due to curling of the belt, and forming uneven images, and has excellent cleaning properties.

The means for solving the aforementioned problems is as follows:

An intermediate transfer belt, containing:

a base layer; and an elastic layer formed on the base layer, wherein the base layer contains polyimide which has a constitutional unit derived from pyromellitic acid and a constitutional unit derived from diaminodiphenyl ether, wherein the intermediate layer has a curling amount of 1.5 mm or less in an absolute value, and wherein the intermediate transfer belt is configured to receive, by transferring, a toner image formed by developing, with a toner, a latent image formed on an image bearing member.

The present invention can solve the aforementioned various problems in the art, and can provide an intermediate transfer belt, which can provide high quality images, has excellent service durability without causing paper jamming due to curling of the belt, and forming uneven images, and has excellent cleaning properties.

Figure 1:
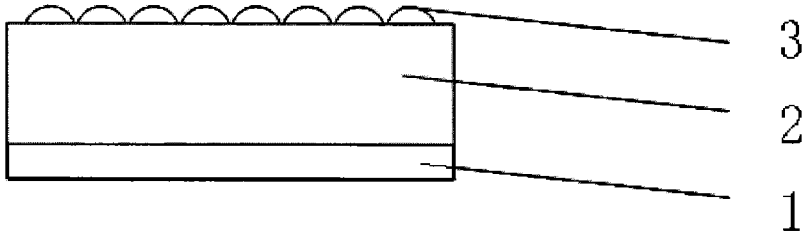
FIG. 1 is a diagram explaining one example of a layer structure of the intermediate transfer belt of the present invention.

DETAILED DESCRIPTION OF THE INVENTION (Intermediate Transfer Belt)

The intermediate transfer belt of the present invention contains at least a base layer, and an elastic layer, and may further contain other layers, if necessary.

The intermediate transfer belt is an intermediate transfer belt configured to receive, by transferring, a toner image formed by developing a latent image formed on an image bearing member with a toner.

The base layer contains polyimide which has a constitutional unit derived from pyromellitic acid and a constitutional unit derived from diaminodiphenyl ether.

The intermediate transfer belt has a curling amount of 1.5 mm or lower in an absolute value.

The present inventors have found the following insights. An intermediate transfer belt containing a base layer, and an elastic layer formed on the base layer, in which the based layer contains polyimide having a constitutional unit derived from pyromellitic acid and a constitutional unit derived from diaminodiphenyl ether, can reduce a curling amount thereof as the direction for which the base layer curls is designed to be reverse to the direction for which the elastic layer curls. As a result, high quality images can be provided, and excellent durability of the intermediate transfer belt can be attained without causing paper jamming due to the curl of the belt and forming uneven images.

For example, when polyimide having a constitutional unit derived from pyromellitic acid and a constitutional unit derived from diaminodiphenyl ether is formed on a mold, the resulting film of the polyimide curls to the inner side (to the side of the mold) at the time it is dried with the mold and separated from the mold. On the other hand, when an elastic layer (e.g., an elastic layer containing a material having a large heat expansion coefficient, such as rubber) is laminated on a material having a small heat expansion coefficient, such as polyimide, the formed elastic layer tends to curl outwards (to the side of the plane opposite to the plane of the polyimide). The present inventors have found out that a curling amount of an intermediate transfer belt is as a whole controlled by canceling curls to each other by combining materials each curling in a different direction to each other.

<Base Layer>

The base layer contains at least polyimide having a constitutional unit derived from pyromellitic acid and a constitutional unit derived from diaminodiphenyl ether, and may further contain other components, if necessary.

—Polyimide—

The polyimide contains at least a constitutional unit derived from pyromellitic acid, and a constitutional unit derived from diaminodiphenyl ether, and may further contain other constitutional units, if necessary.

—Constitutional Unit Derived from Pyromellitic Acid—

The constitutional unit derived from pyromellitic acid can be introduced into the polyimide by synthesizing polyimide using ether pyromellitic acid, or pyromellitic dianhydride, or both thereof.

An amount of the constitutional unit derived from pyromellitic acid in the polyimide is appropriately selected depending on the intended purpose without any limitation, but the amount is preferably 0.1 to 1.0, more preferably 0.2 to 1.0, and even more preferably 0.3 to 0.7, when the amount thereof is determined as a molar ratio of the constitutional unit derived from pyromellitic acid to the total constitutional units derived from polycarboxylic acid in the polyimide (constitutional unit derived from pyromellitic acid/the total amount of the constitutional units derived from polycarboxylic acid). When the amount thereof is within the aforementioned even more preferable range, it is advantageous because the resulting belt tends to curl inward.

—Constitutional Unit Derived from Diaminodiphenyl Ether—

The constitutional unit derived from diaminodiphenyl ether can be introduced into the polyimide by synthesizing polyimide using diaminodiphenyl ether.

Examples of the diaminodiphenyl ether include 4,4'-diaminodiphenyl ether, 3,3'-diaminodiphenyl ether, and 3,4'-diaminodiphenyl ether.

An amount of the constitutional unit derived from diaminodiphenyl ether in the polyimide is appropriately selected depending on the intended purpose without any limitation. The amount thereof is determined as a molar ratio of the constitutional unit derived from diaminodiphenyl ether to the total amount of the constitutional units derived from the amine compound (constitutional unit derived from diaminodiphenyl ether/total amount of constitutional units derived from amine compound), and the molar ratio thereof is preferably 0.1 to 1.0, more preferably 0.2 to 1.0, and even more preferably 0.3 to 0.7. When the amount thereof is within the aforementioned even more preferable range, it is advantageous because the resulting belt has high flexibility.

—Other Constitutional Units—

The aforementioned other constitutional units are appropriately selected depending on the intended purpose without any limitation, and examples thereof include a constitutional unit derived from polycarboxylic acid (exclusive of the constitutional unit derived from pyromellitic acid), and a constitutional unit derived from an amine compound (exclusive of the constitutional unit derived from diaminodiphenyl ether).

By incorporating the aforementioned other constitutional units into the polyimide, the mechanical strength (high elasticity) and flexibility of the base layer can be appropriately adjusted.

Examples of the constitutional unit derived from the polycarboxylic acid include a constitutional unit derived from aromatic tetracarboxylic acid. Examples of the constitutional unit derived from aromatic tetracarboxylic acid include a constitutional unit derived from 4,4'-oxydiphthalic acid, and a constitutional unit derived from 3,3',4,4'-biphenyltetracarboxylic acid.

The constitutional unit derived from aromatic polycarboxylic acid can be introduced into the polyimide, for example, by synthesizing polyimide using either aromatic polycarboxylic acid or aromatic polycarboxylic anhydride, or both thereof.

The aromatic polycarboxylic anhydride is appropriately selected depending on the intended purpose without any limitation, and examples thereof include 4,4'-oxydiphthalic dianhydride, ethylene tetracarboxylic dianhydride, cyclopentane tetracarboxylic dianhydride, 3,3',4,4'-benzophenonetetracarboxylic dianhydride, 2,2',3,3'-benzophenonetetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxylphenyl)-1,1,1,3,3,3-hexafluoropropane dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 1,2,3,4-benzenetetracarboxylic dianhydride, 3,4,9,10-perylenetetracarboxylic dianhydride, 2,3,6,7-anthracenetetracarboxylic dianhydride, and 1,2,7,8-phenanthrenetetracarboxylic dianhydride. These may be used independently, or in combination.

Examples of the constitutional unit derived from the amine compound include a constitutional unit derived from an aromatic diamine compound. Examples of the constitutional unit derived from the aromatic diamine compound include a constitutional unit derived from p-phenylene diamine.

The constitutional unit derived from the aromatic diamine compound can be introduced into the polyimide, for example, by synthesizing polyimide using an aromatic diamine compound.

The aromatic diamine compound is appropriately selected depending on the intended purpose without any limitation. Examples of the aromatic diamine compound include m-phenylene diamine, o-phenylene diamine, p-phenylene diamine, m-aminobenzyl amine, p-aminobenzyl amine, bis(3-aminophenyl)sulfide, (3-aminophenyl)(4-aminophenyl)sulfide, bis(4-aminophenyl)sulfide, (3-aminophenyl)(4-aminophenyl)sulfoxide, bis(3-aminophenyl)sulfone, (3-aminophenyl)(4-aminophenyl)sulfone, bis(4-aminophenyl)sulfone, 3,3'-diaminobenzophenone, 3,4'-diaminobenzophenone, 4,4'-diaminobenzophenone, 3,3'-diaminodiphenyl methane, 3,4'-diaminodiphenyl methane, 4,4'-diaminodiphenyl methane, bis[4-(3-aminophenoxy)phenyl]methane, bis[4-(4-aminophenoxy)phenyl]methane, 1,1-bis[4-(3-aminophenoxy)phenyl]ethane, 1,1-bis[4-(4-aminophenoxy)phenyl]-ethane, 1,2-bis[4-(3-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis(4-aminophenoxy)biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenylsulfone, bis[4-{4-(4-aminophenoxy)phenoxy}phenyl]sulfone, 1,4-bis[4-(4-aminophenoxy)phenoxy]-α,α-dimethylbenzyl]benzene, and 1,3-bis[4-(4-aminophenoxy)-α,α-dimethylbenzyl]benzene. These may be used independently, or in combination.

By incorporating the aforementioned other constitutional units into the polyimide, the mechanical strength (high elasticity) and flexibility of the base layer can be appropriately adjusted.

—Synthesis Method of Polyimide—

The polyimide, especially aromatic polyimide, is insoluble to a solvent due to its rigid backbone chain structure, and has characteristics of non-solubility. Accordingly, the polyimide is synthesized, for example, by synthesizing polyimide precursor (polyamic acid, or polyamide acid), which is soluble to an organic solvent, through a reaction between aromatic polycarboxylic anhydride and an aromatic diamine compound, performing molding process onto the polyamic acid in various methods, and then subjecting the polyamic acid to a dehydration reaction by a thermal or chemical method to induce cyclization (imidization) to thereby form polyimide. Taking as an example a reaction for obtaining the aromatic polyimide, the outline thereof is shown in the following reaction is scheme (1).

Reaction Scheme (1)

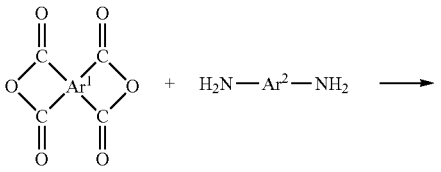

-continued

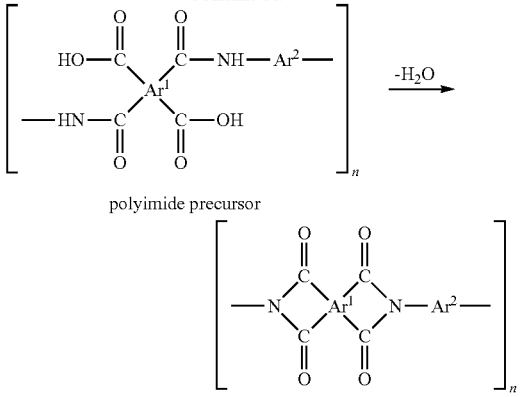

In the reaction scheme (1), $Ar^1$ is a tetravalent aromatic residue containing at least one aromatic ring; and $Ar^2$ is a divalent aromatic residue containing at least one aromatic ring.

In the present invention, the constitutional unit derived from tetracarboxylic acid, which is the aromatic polycarboxylic acid, means a constitutional unit represented by the following general formula (1) having the structure in which a nitrogen atom is removed from the imide bond. The same can be said to the constitutional unit derived from pyromellitic acid.

General Formula (1)

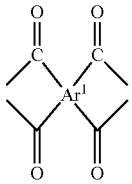

In the general formula (1), $Ar^1$ denotes the same as $Ar^1$ in the reaction scheme (1).

The constitutional unit derived from the aromatic diamine compound means a constitutional unit represented by the following general formula (2) in which two carbonyl groups are removed from the imide bond. The same can be said to the constitutional unit derived from diaminodiphenyl ether.

General Formula (2)

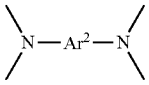

In the general formula (2), $Ar^2$ denotes the same as $Ar^2$ in the reaction scheme (1).

For example, polyimide precursor (polyamic acid) can be attained by performing a polymerization reaction in an organic solvent using the aromatic polycarboxylic anhydride and the aromatic diamine compound of substantially equimolar. In order to attain the polyimide, a combination of at least either the pyromellitic acid, or the pyromellitic dianhydride, at least with the diaminodiphenyl ether can be used in the polymerization reaction.

An organic solvent used for a polymerization reaction to yield the polyamic acid is appropriately selected depending on the intended purpose without any limitation, but it is preferably an organic polar solvent.

Examples of the organic polar solvent include: a sulfoxide-based solvent such as dimethylsulfoxide, and diethyl sulfoxide; a formamide-based solvent such as N,N-dimethylformamide, and N,N-diethylformamide; an acetamide-based solvent such as N,N-dimethylacetamide, and N,N-diethylacetamide; a pyrrolidone-based solvent such as N-methyl-2-pyrrolidone, and N-vinyl-2-pyrrolidone; and a phenol-based solvent such as phenol, o-, m-, or p-cresol, xylenol, halogenated phenol, and catechol; an ether-based solvent such as tetrahydrofuran, dioxane, and dioxolane; an alcohol-based solvent such as methanol, ethanol, and butanol; a cellosolve-based solvent such as butyl cellosolve; hexamethylphosphoramide; and γ-butyrolactone. These may be used independently, or in combination. Among them, N,N-dimethylacetamide, and N-methyl-2-pyrrolidone are preferable because they are highly soluble and easy to polymerize.

One example of a synthesis method for the polyimide precursor is described hereinafter.

First, a diamine compound containing at least the diaminodiphenyl ether is dissolved in the organic solvent, or dispersed therein to form slurry in an inert atmosphere of nitrogen or the like. To the resulting solution, an aromatic polycarboxylic anhydride containing at least the pyromellitic dianhydride or a derivative thereof (which may be in the state of a solid, a solution being dissolved in an organic solvent, or a slurry) is added to thereby proceed to a ring-opening polyaddition reaction with generation of heat. As a result, the solution suddenly increases its viscosity, to thereby yield a solution of polymic acid (polyimide precursor) of high molecular weight.

The reaction time for the synthesis of the polyimide precursor is appropriately selected depending on the intended purpose without any limitation, and it is, for example, about 30 minutes to about 12 hours.

The reaction temperature for the synthesis of the polyimide precursor is appropriately selected depending on the intended purpose without any limitation, but it is preferably in the range of −20° C. to 100° C., more preferably in the range of −20° C. to 60° C.

The example described above is one example. Conversely to the order of addition above, first, aromatic polycarboxylic anhydride or a derivative thereof is dissolved or dispersed in an organic solvent in advance, and to the resulting solution, the aromatic diamine compound may be added. The aromatic diamine compound may be added in the state of a solid, or a solution prepared by dissolving the aromatic diamine compound in an organic solvent, or a slurry. Namely, the order for adding the aromatic polycarboxylic dianhydride and the aromatic diamine compound is not limited. Further, aromatic tetracarboxylic dianhydride serving as aromatic polycarboxylic anhydride and the aromatic diamine compound may be simultaneously added to the organic polar solvent to proceed to a reaction.

In the manner as described above, an equimolar aromatic polycarboxylic anhydride or a derivative thereof, and an equimolar aromatic diamine compound are subjected to a polymerization reaction in an organic polar solvent, to thereby yield a polyamic acid (polyimide precursor) solution in the state that polyamic acid is uniformly dissolved in the organic polar solvent.

The polyamic acid can be imidized by a (1) heating method, or a (2) chemical method. The (1) heating method is a method for transforming (imidizing) the polyamic acid to polyimide by heating the polyamic acid to 200° C. to 350° C., and is a simple and practical method for attaining polyimide (a polyimide resin). The (2) chemical method is a method in which after reacting the polyamic acid with a cyclodehydration reagent (e.g., a mixture of carboxylic anhydride and tertiary amine), the resultant is heated to thereby completely imidize the polyamid acid, and a complicated and costly method compared to the (1) heating method. From this reason, generally, the (1) heating method is commonly used.

Note that, for allowing polyimide to exhibit its inherited performance, it is preferred that imidization be completed by heating the polyimide to the temperature which is equal to or higher than a glass transition temperature of the respective polyimide.

—Other Components—

The aforementioned other components are appropriately selected depending on the intended purpose without any limitation, and examples thereof include an electrical resistance-controlling agent, a dispersing agent, a reinforcing agent, a lubricant, a thermal conducting agent, and an antioxidant.

—Electrical Resistance-Controlling Agent—

The electrical resistance-controlling agent is filler (or an additive) for adjusting electrical resistance in the base layer.

Examples of the electrical resistance-controlling agent include metal oxide, carbon black, an ion conductive agent, and an electric conductive polymer material.

Examples of the metal oxide include zinc oxide, tin oxide, titanium oxide, zirconium oxide, aluminum oxide, and silicon oxide. Other examples thereof include products obtained by subjecting the above metal oxide to a surface treatment for improving dispersibility thereof.

Examples of the carbon black include ketjen black, furnace black, acetylene black, thermal black and gas black.

Examples of the ion conductive agent include a tetraalkyl ammonium salt, a trialkylbenzyl ammonium salt, an alkylsulfonic acid salt, an alkylbenzenesulfonic acid salt, alkylsulfate, glycerin fatty acid ester, sorbitan fatty acid ester, polyoxyethylenealkylamine, ester of polyoxyethylenealiphatic alcohol, alkyl betaine, and lithium perchlorate.

Examples of the electric conductive polymer material include polyparaphenylene, polyaniline, polythiophene, and polyparaphenylenevinylene.

The electrical resistance-controlling agent may be used independently, or in combination.

An amount of the electrical resistance-controlling agent in the base layer is appropriately selected depending on the intended purpose without any limitation. In the case where the electrical resistance-controlling agent is the carbon black, the amount thereof is preferably 10% by mass to 25% by mass, more preferably 15% by mass to 20% by mass, relative to the base layer. In the case where the electrical resistance-controlling agent is the metal oxide, the amount thereof is preferably 1% by mass to 50% by mass, more preferably 10% by mass to 30% by mass, relative to the base layer.

When the amount thereof is lower than the lower limit of the aforementioned preferable range, an effect of controlling electric resistance may not be sufficiently attained. When the amount thereof is higher than the upper limit, mechanical strength of the resulting intermediate transfer belt may reduce.

The average thickness of the base layer is appropriately selected depending on the intended purpose without any limitation, but it is preferably 40 μm to 120 μm, more preferably 50 μm to 80 μm. When the average thickness thereof is less than 40 μm, a sufficient strength cannot be attained, which may lead to reduction in a shape stability of the resulting intermediate transfer member. In this case, moreover, the curling amount (for example, an amount of the base layer curling to the side of the plane in contact with a mold when it is produced using the mold) is small, but the resulting intermediate transfer belt as a whole tends to curl (for example, a laminate of the base layer and an elastic layer tends to curl to the side of the elastic layer). When the average thickness of the base layer is greater than 120 μm, not only the resulting intermediate transfer belt tends to curl (for example, the base layer tends to curl to the side of the plane in contact with a mold when the base layer is produced using the mold), but also the intermediate transfer belt tends to crack because of the bend thereof by a roller during running, which leads to lack of the durability.

The average thickness is an average value of the values of the thickness measured at arbitrarily selected 10 spots.

Note that, the thickness can be measured, for example, by an electric micrometer manufactured by Anritsu Corporation.

The electric resistance of the base layer is appropriately selected depending on the intended purpose without any limitation. The electric resistance thereof is preferably $1\times10^{8}\Omega/\square$ to $1\times10^{14}\Omega/\square$ in the surface resistance, and $1\times10^{7}$ Ω·cm to $1\times10^{13}$ Ω·cm in the volume resistance.

The base layer is preferably an endless base layer.

—Formation Method of Base Layer—

A formation method of the base layer is appropriately selected depending on the intended purpose without any limitation. Examples thereof include a method containing: preparing a coating liquid in which the aforementioned other components such as the electrical resistance-controlling agent are optionally dispersed in the polyimide precursor solution (polyamic acid solution); applying the coating liquid onto a support; and transforming (imdizing) polyamic acid, which is polyimide precursor, into polyimide, as well as forming the coating liquid into a layer by a processing, such as heating.

The support is appropriately selected depending on the intended purpose without any limitation, and examples thereof include a cylindrical metal mold.

One example of the production method of the base layer is specifically explained.

A coating liquid containing polyimide precursor is applied onto a cylindrical mold, such as a cylindrical metal mold, by a liquid supplying device, such as a nozzle and a dispenser, while slowly rotating the cylindrical mold, so as to uniformly coat the outer surface of the cylindrical mold with the coating liquid, to thereby perform flow casting (forming a coating film). Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of 80° C. to 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 250° C. to about 450° C., to thereby sufficiently imidize the polyimide precursor.

<Elastic Layer>

The elastic layer contains at least a material having elasticity, and may further contain other components, if necessary.

The elastic layer is a layer having micro rubber hardness of 90° or lower in the environment of 25° C., 50% RH. For the measurement of the micro rubber hardness, a commercially available micro rubber hardness tester can be used. For example, the micro rubber hardness can be measured by means of MD-1, manufactured by KOBUNSHI KEIKI CO., LTD.

—Material Having Elasticity—

The material having elasticity is appropriately selected depending on the intended purpose without any limitation, and examples thereof include elastomer, and rubber.

—Elastomer—

The elastomer is appropriately selected depending on the intended purpose without any limitation, and examples thereof include a thermoplastic elastomer, and a thermosetting elastomer. These may be used independently, or in combination.

The thermoplastic elastomer is appropriately selected depending on the intended purpose without any limitation, and examples thereof include a polyester elastomer, a polyamide elastomer, a polyether elastomer, a polyurethane elastomer, a polyolefin elastomer, a polystyrene elastomer, a polyacryl elastomer, a polydiene elastomer, a silicone-modified polycarbonate elastomer, and a fluorocopolymer elastomer.

The thermosetting elastomer is appropriately selected depending on the intended purpose without any limitation, and examples thereof include a polyurethane elastomer, a silicone-modified epoxy elastomer, and a silicone-modified acryl elastomer.

—Rubber—

The rubber is appropriately selected depending on the intended purpose without any limitation, and examples thereof include isoprene rubber, styrene rubber, butadiene rubber, nitrile rubber, ethylenepropylene rubber, butyl rubber, silicone rubber, chloroprene rubber, acryl rubber, chlorosulfonated polyethylene, fluorine rubber, urethane rubber, hydrin rubber, acrylonitrile butadiene rubber, and vulcanized rubber. These may be used independently, or in combination. Among them, acrylonitrile butadiene rubber and vulcanized rubber are preferable because they are excellent in coherence and adhesion with particles owing to the effect of the functional group contributing to the curing reaction at the time when the particles are fixed onto a surface of the elastic layer, and can securely fix the particles thereon without needing an adhesive layer.

—Other Components—

The aforementioned other components are appropriately selected depending on the intended purpose without any limitation, and examples thereof include an electrical resistance-controlling agent, a flame retardant for imparting flame resistance, an antioxidant, a reinforcing agent, fillers, and a vulcanization promoter. These may be used independently, or in combination.

—Electrical Resistance-Controlling Agent—

The electrical resistance-controlling agent is appropriately selected depending on the intended purpose without any limitation. Since the electrical resistance-controlling agent such as carbon black, and metal oxide impair the flexibility of the elastic layer, an amount thereof for use is preferably kept the minimum. Moreover, use of an ion conductive agent, or an electric conductive polymer material as the electrical resistance-controlling agent is preferable.

The average thickness of the elastic layer is appropriately selected depending on the intended purpose without any limitation, but it is preferably 400 μm to 1,500 μm, more preferably 500 μm to 1,000 μm. When the average thickness of the elastic layer is less than 400 μm, the resulting belt may reduce its correspondence to the surface configuration of a transfer medium, and may reduce an effect of reducing transfer pressure. When the average thickness thereof is greater than 1,500 μm, the resulting belt tends to sag because of its weight, which may cause instability in running, and may cause cracking of the belt as being bent by a curvature of a roller around which the belt is supported.

In the case where the intermediate transfer belt is an endless belt whose peripheral length is 1,000 mm or greater, the average thickness of the elastic layer is preferably 1,500 μm or less, as the thermal contraction amount thereof increases, and the belt tends to curl outwards even more.

The average thickness is the average value of the measurement values obtained by measuring a thickness on arbitrarily selected 10 spots. The thickness can be measured, for example, by observing a cross-section of the belt under a scanning electron microscope, VE-7800, manufactured by Keyence Corporation.

The electric resistance of the elastic layer is appropriately selected depending on the intended purpose without any limitation. For example, the electric resistance thereof is preferably $1\times10^{8}\Omega/\square$ to $1\times10^{13}\Omega/\square$ in the surface resistance, and $1\times10^{7}$ Ω·cm to $1\times10^{13}$ Ω·cm in the volume resistance.

—Surface of Elastic Layer—

The surface configuration of the elastic layer is appropriately selected depending on the intended purpose without any limitation, but it is preferably a convexoconcave surface configuration formed by aligning spherical particles along the plane direction, in view of transferring ability to paper.

—Spherical Particles—

The spherical particles are appropriately selected depending on the intended purpose without any limitation, and examples thereof include: spherical particles formed mainly of a resin (e.g., an acrylic resin, a melamine resin, a polyamide resin, a polyester resin, a silicone resin, and a fluorine resin) or rubber: hollow or microporous spherical particles obtained by subjecting the above-listed spherical particles to a surface treatment with a dissimilar material; spherical particles in each of which a surface of a particle formed of a rubber-based material is coated with a hard resin; and spherical silicone resin or fluororesin particles produced by adjusting their shapes during the polymerization.

Among them, spherical silicone resin particles or fluororesin particles prepared by controlling their shapes during the polymerization are preferable because they have lubricating property and can give releasing property to toner, and abrasion resistance to the resulting belt. The silicone resin particles or fluororesin particles whose shapes are closer to sphere are more preferable.

In the present specification, the term "spherical particles" means a group of particles having the average particle diameter of 100 μm or less, having spherical shapes, being insoluble to an organic solvent, and having a 3% thermal decomposition temperature of 200° C. or higher.

The spherical particles are not particularly limited, and may be appropriately synthesized for use, or selected from the commercially available products. Examples of the commercially available product include silicone particles (product of Momentive Performance Materials Inc., trade names "TOSPEARL 120," "TOSPEARL 145" "TOSPEARL 2000B") and acryl particles (product of SEKISUI PLASTICS CO., LTD., trade name "Techno Polymer MBX-SS").

The configuration of the alignment of the spherical particles is appropriately selected depending on the intended purpose without any limitation, and examples thereof include a configuration in which the spherical particles are aligned to form a monolayer with respect to the thickness direction of the elastic layer, and a configuration in which a plurality of the spherical particles are aligned with respect to the thickness direction of the elastic layer.

Among them, the configuration in which the spherical particles are aligned to form a monolayer with respect to the thickness direction of the elastic layer is preferable because the spherical particles can be easily and uniformly aligned by directly applying powder of the spherical particles onto the elastic layer, and leveling the applied spherical particles, and as a result, formation of high quality images can be stably maintained.

On the other hand, the configuration in which a plurality of the spherical particles are aligned with respect to the thickness direction of the elastic layer may have uneven distribution of the spherical particles, and may cause image disturbances because of uneven electric properties of the surface of the belt influenced by the electric resistance of the spherical particles. Specifically, the area of the belt where the spherical particles are present in a large amount has high electric resistance, and generates surface potential due to the residual electric charge. As a result, there are variations in the surface potential in the surface of the belt, and the image disturbance, such as causing a difference in the image density between the adjacent areas, may become significant.

The volume average particle diameter of the spherical particles is appropriately selected depending on the intended purpose without any limitation, but it is preferably 0.1 μm to 10.0 μm, and more preferably 0.3 μm to 3.0 μm. Moreover, the spherical particles are preferably monodisperse particles having a sharp particle size distribution.

—Method for Forming Elastic Layer Having Convexoconcave Surface Configuration—

Figure 3:
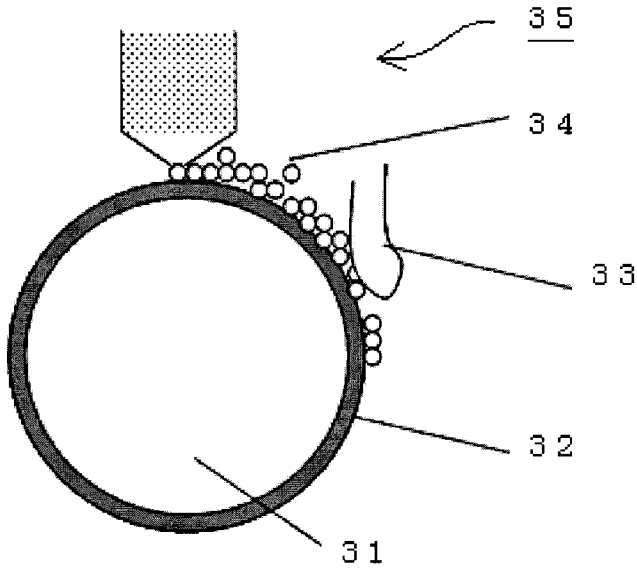
FIG. 3 is a diagram illustrating one example of the method for uniformly embedding spherical particles on a surface of an elastic layer.

The method for forming the elastic layer having the convexoconcave surface configuration is appropriately selected depending on the intended purpose without any limitation. For example, as illustrated in FIG. 3, there is a method in which a powder supplying device 35 and a pressing member 33 are provided; spherical particles 34 are applied from the powder supplying device 35 and uniformly spread onto a surface of the elastic layer, while rotating the belt 32; the spread spherical particles 34 on the surface of the elastic layer are embedded into the elastic layer of the belt 32 which has been formed on a metal drum 31 and has formed of a laminate of a base layer and the elastic layer by pressing with the pressing member 33 at a constant pressure; excessive spherical particles 34 are removed; and a uniform convexoconcave surface configuration is formed at the surface of the elastic layer followed by heating at predetermined temperature for a predetermined time while rotating the belt 32, to thereby cure the elastic layer.

Use of monodisperse spherical particles as the spherical particles used for forming the elastic layer having a convexoconcave surface configuration enables to form a uniform particle layer only with a leveling process by the pressing member.

—Method for Forming Elastic Layer—

A method for forming the elastic layer is appropriately selected depending on the intended purpose without any limitation, and examples thereof include: a method forming an elastic layer on a base layer by injection molding, or extrusion; and a method for forming an elastic layer by applying a coating liquid containing materials for forming an elastic layer onto a base layer.

One example of the method for forming an elastic layer is specifically explained.

The endless based layer fitted in a cylindrical metal mold is slowly rotated, and a coating liquid containing materials for forming an elastic layer is uniformly applied onto an entire outer surface of the cylinder by a liquid supplying device, such as a nozzle or a dispenser to thereby perform flow casting (forming a coating film). Thereafter, the rotational speed is increased to the predetermined speed. Once the rotational speed reaches the predetermined speed, the rotational speed is kept constant to continue the rotation and to sufficiently level the coating film, to thereby form an elastic layer. Note that, heating is optionally performed during the rotating.

<Other Layers>

The aforementioned other layers include, for example, a releasing layer is included.

—Releasing Layer—

The releasing layer is optionally formed for the purpose of enhancing releasing properties to a toner, and cleaning ability.

The releasing layer is formed, for example, by coating a resin on the elastic layer.

The micro rubber hardness of the intermediate transfer belt is appropriately selected depending on the intended purpose without any limitation, but it is preferably 60° or lower, more preferably 50° or lower in view of correspondence to paper having surface irregularities, and deformability of the belt.

The micro rubber hardness can be measured, for example, by a micro rubber hardness tester (MD-1, manufactured by KOBUNSHI KEIKI CO., LTD.).

The curling amount of the intermediate transfer belt is preferably 1.5 mm or less in an absolute value, preferably 1.0 mm or less, and even more preferably 0.9 mm or less.

The curling amount of the intermediate transfer belt can be determined by using a sample, which has been cut out to the size of 10 cm×10 cm, leaving the sample in the environment of 25° C., 50% RH for 24 hours, and measuring the portion at which the sample is most curled. Note that, for the measurement of the curling amount, outer curl (the curl of a laminate of the base layer and the elastic layer to the side of the elastic layer) is determined as plus in value, and inner curl (the curl of a laminate of the base layer and the elastic layer to the side of the base layer) is determined as minus in value.

The intermediate transfer belt is preferably an endless belt, namely a seamless belt. In the case where the intermediate transfer belt is an endless belt, the peripheral length of the intermediate transfer belt is appropriately selected depending on the intended purpose without any limitation, but it is preferably 1,000 mm or greater, more preferably 1,100 mm to 3,000 mm. Since the intermediate transfer belt hardly curls, the intermediate transfer belt can sufficiently exhibit the obtainable effect of the present invention even when it is used as an endless belt having a long peripheral length, which generally curls easily. The endless belt having a long peripheral length (e.g., 1,000 mm or greater) is suitably used, for example, in a large-size image forming apparatus that can correspond to high printing speed with a large number of print outputs. The large-size image forming apparatus is an image forming apparatus for which there are currently great demands.

<Method for Producing Intermediate Transfer Belt>

A method for producing the intermediate transfer belt is appropriately selected depending on the intended purpose without any limitation, and examples thereof include a method including forming a base layer on a cylindrical metal mold, and laminating an elastic layer on the base layer.

A method for forming the base layer is appropriately selected depending on the intended purpose without any limitation, and examples thereof include the methods listed in the description of the base layer.

A method for forming the elastic layer is appropriately selected depending on the intended purpose without any limitation, and examples thereof include the methods listed in the description of the elastic layer.

The metal mold can be taken out after sufficiently cooled.

(Image Forming Apparatus)

The image forming apparatus of the present invention contains an image bearing member configured to form a latent image thereon and bear a toner image; a developing unit configured to develop, with a toner, the latent image formed on the image bearing member to thereby form a toner image; an intermediate transfer belt to which the toner image developed by the developing unit is primary transferred; and a transferring unit configured to secondary transfer the toner image borne on the intermediate transfer belt onto a recording medium. The image forming apparatus of the present invention may further contain appropriately selected other units, such as a diselectrification unit, a cleaning unit, a recycling unit, and a controlling unit, if necessary.

In this case, the image forming apparatus is a full-color image forming apparatus, and preferably contains a plurality of image bearing members where the image bearing members are tandemly aligned and each have the developing unit of a respective color.

The intermediate transfer belt used in the belt structure unit mounted in the image forming apparatus of the present invention will be specifically explained hereinafter, with reference to the main section schematic diagram. Note that, the schematic diagram illustrates one example of the present invention, and shall not be construed as to limit the scope of the present invention.

FIG. 1 illustrates one example of a layer structure of an intermediate transfer belt suitably used in the present invention.

The layer structure illustrated in FIG. 1 is a structure containing a rigid base layer 1 having a some degree of flexibility, and a flexible elastic layer 2 laminated on the base layer 1, and further contains spherical particles 3 partially embedded in the elastic layer 2 to thereby form a convexoconcave surface configuration at the elastic layer 2.

Figure 2:
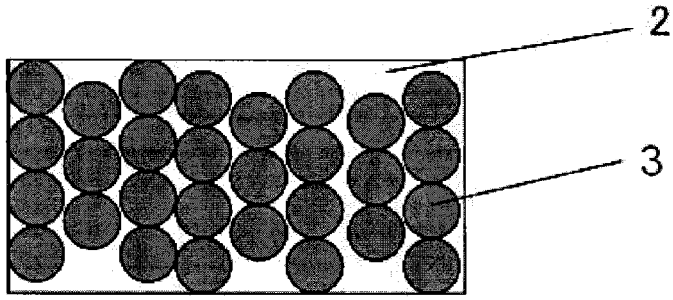
FIG. 2 is a diagram explaining one example of a surface structure of the intermediate transfer belt of the present invention.

FIG. 2 illustrates one example of the surface structure of the intermediate transfer belt suitably used in the present invention.

The surface configuration of the elastic layer is a convexoconcave surface configuration formed by aligning spherical particles 3 on the elastic layer 2 in the form of a monolayer in the plane direction.

Figure 4:
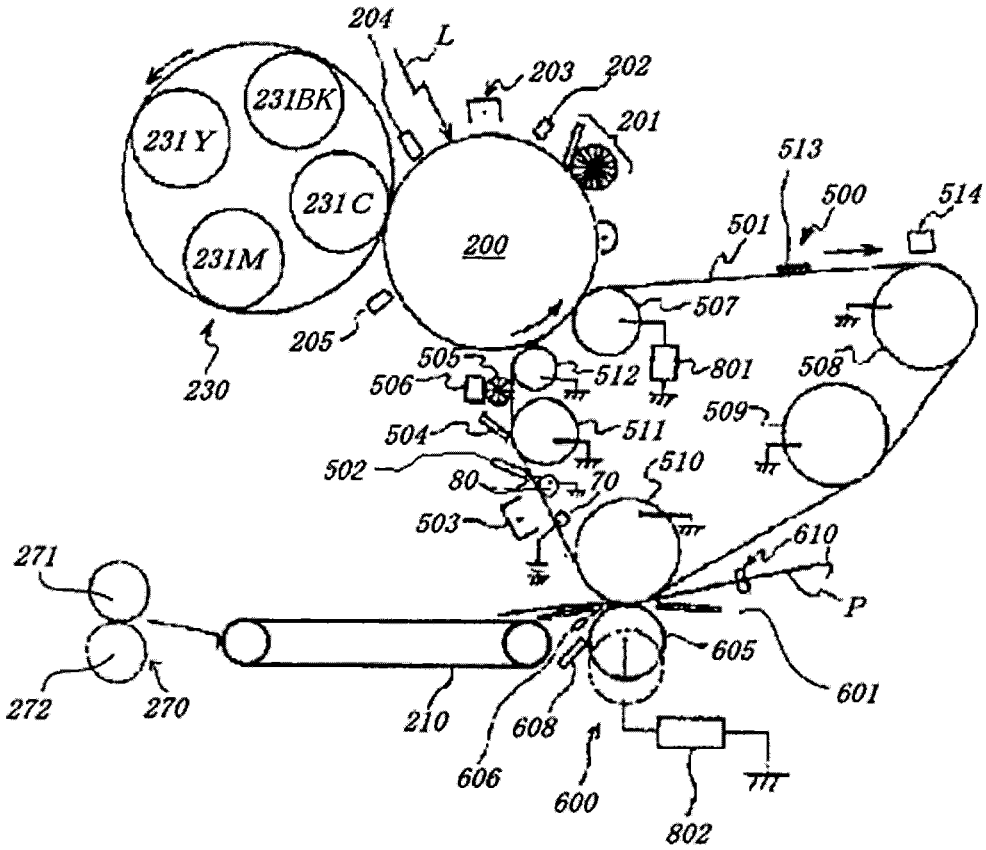
FIG. 4 is a schematic main section diagram explaining one example of the image forming apparatus of the present invention.

FIG. 4 is a schematic diagram of a main section for explaining one example of the image forming apparatus (a color photocopier) of the present invention equipped with the intermediate transfer belt of the present invention as a belt member. The intermediate transfer unit 500 including the belt member of FIG. 4 include an intermediate transfer belt 501, which is an intermediate transfer belt supported by a plurality of rollers. In the surrounding area of the intermediate transfer belt 501, a secondary transfer bias roller 605, which is a secondary transfer charge applying unit of a secondary transfer unit 600, a belt cleaning blade 504, which is an intermediate transfer belt cleaning unit, and a lubricant applying brush 505, which is a lubricant applying member of a lubricant applying unit are provided so as to face the intermediate transfer belt 501.

Moreover, a position detecting mark (not illustrated) is provided on the outer surface or inner surface of the intermediate transfer belt 501. In the case where the position detecting mark is provided on the outer surface of the intermediate transfer belt 501, the position detecting mark needs to be provided to avoid the region where a belt cleaning blade 504 will pass through, which is sometimes difficult in view of the arrangements. In such case, the position detecting mark may be provided on the side of the inner surface of the intermediate transfer belt 501. An optical sensor 514 as a mark detecting sensor is provided in the position between a primary transfer bias roller 507, and a belt driving roller 508 around which the intermediate transfer belt 501 is supported.

The intermediate transfer belt 501 is supported by the primary transfer bias roller 507, which is a primary transfer charge applying unit, the belt driving roller 508, a belt tension roller 509, a secondary transfer counter roller 510, a cleaning counter roller 511, and a feed back current detecting roller 512. Each roller is formed of an electric conductive material, and all of the rollers, exclusive of the primary transfer bias roller 507, are earthed. To the primary transfer bias roller 507, transfer bias whose current or voltage is controlled to have a certain value depending on the number of toner images superimposed is applied from a primary transfer power source 801 which is controlled to provide constant current or constant voltage.

The intermediate transfer belt 501 is driven to rotate in the direction shown with the arrow by a belt driving roller 508 that is driven to rotate in the direction shown with the arrow by a driving motor (not illustrated). The belt member, the intermediate transfer belt 501, is typically a semiconductor or insulator, and has a single layer or multilayer structure. In the preferable embodiment of the present invention, a seamless belt is preferably used as the intermediate transfer belt 501, and using the seamless belt as the intermediate transfer belt enables to improve the durability of the intermediate transfer belt, as well as realizing excellent image formation. Moreover, the intermediate transfer belt is designed to have a size larger than the maximum size for feedable paper so that toner images formed on a photoconductor drum 200, which is an image bearing member, can be superimposed thereon.

The secondary transfer bias roller 605, which is a secondary transfer unit, is mounted detachable to the area in the outer surface of the intermediate transfer belt 501 where it is supported around the secondary transfer counter roller 510, by a separation system serving as the below-mentioned moving unit. The secondary transfer bias roller 605 is mounted so as to nip a recording paper with the area of the intermediate transfer belt 501 where it is supported around the secondary transfer counter roller 510. To the secondary transfer bias roller 605, transfer bias of the predetermined current is applied from the secondary transfer power source 802 which is controlled to provide constant current.

The registration rollers 610 are configured to send the transfer paper P, which is a transfer member, between the secondary transfer bias roller 605 and the intermediate transfer belt 501 supported by the secondary transfer counter roller 510, with the predetermined timing. Moreover, a cleaning blade 608, which is a cleaning unit, is brought into contact with the secondary transfer bias roller 605. The cleaning blade 608 is configured to remove the depositions deposited on the surface of the secondary transfer bias roller 605 to thereby clean the secondary transfer bias roller 605.

Once a image formation cycle is started in the color photocopier of the aforementioned structure, the photoconductor drum 200 is rotated in the anticlockwise direction shown with the arrow by the driving motor (not illustrated), and operations are performed to form a black (BK) toner image, a cyan (C) toner image, a magenta (M) toner image, and a yellow (Y) toner image on the photoconductor drum 200. The intermediate transfer belt 501 is rotated in the clockwise direction shown with the arrow by the belt driving roller 508. Along with the rotation of the intermediate transfer belt 501, primary transfer of the BK toner image, the C toner image, the M toner image, and the Y toner image are performed by transfer bias generated by the voltage applied to the primary transfer bias roller 507, and ultimately each of the toner images are superimposed and formed in the order of BK, C, M, and Y on the intermediate transfer belt 501.

For example, the formation of the BK toner image is carried out as follows. In FIG. 4, a charger 203 uniformly charges the surface of the photoconductor drum 200 with the negative charge of the predetermined electric potential by corona discharger. Based on the belt mark detecting signal, the timing for the operation is determined, and ruster exposure is carried out with laser beams by means of a writing optical unit (not illustrated) based on the BK color image signal. When the ruster image is formed by the exposure, the exposed area of the initially uniformly charged surface of the photoconductor drum 200 loses its electric charge in the amount proportional to the exposure value, to thereby form a BK latent electrostatic image. By bringing the negatively charged BK toner on a developing roller of the BK developing unit 231BK into contact with the BK latent electrostatic image, the toner is adsorbed on the area of the photoconductor drum 200 where there is not electric charge, that is the exposed area, without depositing the toner on the area where the electric charge remains, to thereby form a BK toner image identical to the latent electrostatic image.

The BK toner image formed on the photoconductor drum 200 in the aforementioned manner is primary transferred to the outer surface of the intermediate transfer belt 501 which is driven to rotate at the same speed to the rotational speed of the photoconductor drum 200 in the state that it is in contact with the photoconductor drum 200. After the primary transferring, a small amount of the toner remained on the surface of the photoconductor drum 200 without being transferred is cleaned by a photoconductor cleaning device 201 to thereby be recovered and re-used for the photoconductor drum 200. After the formation of the BK image, the photoconductor drum 200 proceeds to the operation for a C image formation. The color scanner starts reading the C image data with the predetermined timing, and a C latent electrostatic image is formed on the surface of the photoconductor drum 200 by writing the C image data with laser beams.

After the rear edge of the BK latent electrostatic image is passed through and before the top edge of the C latent electrostatic image reaches, a revolver developing unit 230 is revolved to set the C developing unit 231C in the developing position, and the C latent electrostatic image is developed with the C toner. Thereafter, the region of the C latent electrostatic image is continued to be developed. When the rear edge of the C latent electrostatic image is passed through, however, the revolver developing unit is revolved in the same manner in the case of the aforementioned BK developing unit 231BK, to move the M developing unit 231M into the developing position. This operation is completed, as in the manner mentioned above, before the top edge of the next Y latent electrostatic image reaches. The explanations of operations for M image formation using a M developing unit 231M and Y image formation using a Y developing unit 231Y are omitted here because the operations of color image reading, latent electrostatic formation, and developing are the same to those of BK, and C.

The BK, C, M, and Y toner images sequentially formed on the photoconductor drum 200 in the aforementioned manner are sequentially positioned and primary transferred on the identical surface of the intermediate transfer belt 501. As a result, a toner image, in which at maximum, four colors are superimposed, is formed on the intermediate transfer belt 501. Meanwhile, with the timing of starting the operation of the image formation, the transfer paper P is fed from the paper feeding unit, such as a transfer paper cassette and a manual feeding tray, and is stood by at the nip between the registration rollers 610. When the top edge of the toner image on the intermediate transfer belt 501 comes to a secondary transfer section formed with a nip between the intermediate transfer belt 501 supported by the secondary transfer counter roller 510 and the secondary transfer bias roller 605, the registration rollers 610 are driven to transfer the transfer paper along the transfer paper guide plate 601 in the manner that the top edge of the transfer paper P meets the top edge of the toner image, to thereby perform the registration of the transfer paper P with the toner image.

Once the transfer paper P reaches the secondary transfer section in the manner described above, the four-color superimposed toner image on the intermediate transfer belt 501 is collectively transferred (secondary transferred) onto the transfer paper P by transfer bias generated by the voltage applied to the secondary transfer bias roller 605 by the secondary transfer power source 802. The transfer paper is then transported along the transfer paper guide plate 601, and is diselectrified by passing the area facing to the transfer paper diselectrification charger 606 formed of a diselectrification needle, disposed in the downstream of the secondary transfer section, followed by transported towards a fixing device 270 by a belt conveying device 210, which is a belt element (see FIG. 4). Thereafter, the toner image on the transfer paper P is fused and fixed thereon at the nip between the fixing rollers 271, 272 of the fixing device 270, followed by sending out the transfer paper P from the device main body by discharging roller (not illustrated) to be stacked on a copy tray (not illustrated) with the top side up. Note that, the fixing device 270 optionally has a belt element, if necessary.

Meanwhile, the surface of the photoconductor drum 200 after the belt transferring is cleaned by the photoconductor cleaning device 201, and is uniformly diselectrified by the diselectrification lamp 202. Moreover, the residual toner on the outer surface of the intermediate transfer belt 501 after secondary transferring the toner images on the transfer paper P is cleaned by a belt cleaning blade 504. The belt cleaning blade 504 is designed to come into contact with the outer surface of the intermediate transfer belt 501 with the predetermined timing by means of a cleaning member moving unit, which is not illustrated in the drawing.

At the upstream of the belt cleaning blade 504 in the traveling direction of the intermediate transfer belt 501, a toner sealing member 502 coming in contact with and moving away from the outer surface of the intermediate transfer belt 501 is provided. The toner sealing member 502 receives the toner fell off from the belt cleaning blade 504 during the cleaning of the residual toner, to thereby prevent the fallen toner from scattering onto the transporting path of the transfer paper P. The toner sealing member 502 is brought into contact with or moved away from the outer surface of the intermediate transfer belt 501 by means of the cleaning member moving unit, together with the belt cleaning blade 504.

To the outer surface of the intermediate transfer belt 501 from which the residual toner has been removed in the aforementioned manner, a lubricant 506 is applied by a lubricant applying brush 505. The lubricant 506 is formed of a solid, such as zinc stearate, and is provided so as to be in contact with the lubricant applying brush 505. Moreover, the residual charge remained on the outer surface of the intermediate transfer belt 501 is eliminated by diselectrification bias applied by a belt diselectrification brush, which is not illustrated, and is provided to be in contact with the outer surface of the intermediate transfer belt 501. Here, the lubricant applying brush 505 and the belt diselectrification brush are each designed to come into contact with and move away from the circumferential surface of the intermediate transfer belt 501 with the predetermined timing, by means of a moving unit not illustrated in the drawing.

In the case of repeated photocopying, as for the operations of the color scanner and the image formation on the photoconductor drum 200, the image forming operation of the first color (BK) for the second sheet starts with the predetermined timing following to the image forming operation of the fourth color (Y) for the first sheet. Moreover, following to the operation for collectively transferring the superimposed four color toner images for the first sheet, the intermediate transfer belt 501 receives the BK toner image for the second sheet, which is primary transferred, with the region of the circumferential surface thereof where cleaning has been performed with the belt cleaning blade 504. The same operation to that for the first sheet is performed thereafter. The explained above is a copy mode to give a four color full-color copy, but in case of a three color copy mode or two color copy mode, the same operations to the above are performed according to the designated colors and rotations. In the case of a monocolor copy mode, only the developing device of the predetermined color of the revolver developing unit 230 is driven in the developing operation state before copying of the predetermined number of sheets is completed, and the copying operation is performed with the belt cleaning blade 504 remaining in contact with the intermediate transfer belt 501.

In FIG. 4, the reference L denotes an exposure unit, the numeral reference 70 denotes a diselectrification roller, the numeral reference 80 denotes an earth roller, the numeral reference 204 denotes an electric potential sensor, the numeral reference 205 denotes a toner image density sensor, the numeral reference 503 denotes a charger, and the numeral reference 513 denotes a toner image.

Figure 5:
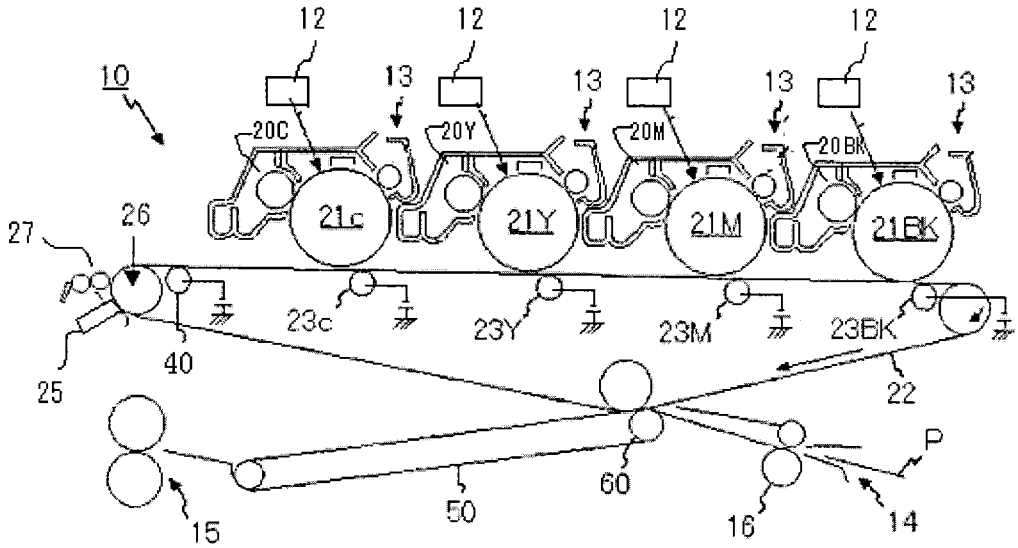
FIG. 5 is a schematic main section diagram explaining another example of the image forming apparatus of the present invention.

Although the photocopier equipped with only one photoconductor drum has been explained above, the present invention can be also applied for an image forming apparatus in which a plurality of photoconductor drums are aligned and provided along one intermediate transfer belt formed of a seamless belt, for example, as illustrated in FIG. 5 of the main section schematic diagram. FIG. 5 illustrates one configuration example of a four-drum digital color copier equipped with four photoconductor drums 21BK, 21Y, 21M, 21C for forming toner images of four different colors (black, yellow, magenta, and cyan).

In FIG. 5, the printer main body 10 is equipped with an image writing unit 12, an image forming unit 13, and a paper feeding unit 14, all of which are for performing color image formation by electrophotography. Image processing is performed by an image processing unit based on the image signal to convert into signals for each color black (BK), magenta (M), yellow (Y), cyan (C) for image forming, and the resulting signals are sent to the image writing unit 12. The image writing unit 12 is a scanning optical system, for example, constituted of a laser light source, a deflector such as a rotating polygon mirror, a scanning imagery optical system, and a group of mirrors, and has four wiring optical paths each corresponding to a respective color signal. The image writing unit 12 writes on each of the image bearing members (photoconductors) 21BK, 21M, 21Y, 21C, which are image bearing members each provided for a respective color in the image forming unit 13, corresponding to each color signal.

The image forming unit 13 is equipped with the photoconductors 21BK, 21M, 21Y, 21C, which are image bearing members for black (BK), magenta (M), yellow (Y), and cyan (C), respectively. As for each photoconductor of each color, an OPC photoconductor is generally used. In the surrounding area of each of the photoconductors 21BK, 21M, 21Y, 21C, a charging device, a section exposed to laser light emitted from the image wiring unit 12, a developing device 20BK, 20M, 20Y, or 20C of a respective color, black, magenta, yellow or cyan, a primary transfer bias roller 23BK, 23M, 23Y or 23C as a primary transferring unit, a cleaning device (not illustrated), and a photoconductor diselectrification device (not illustrated) are provided. Note that, the developing devices 20BK, 20M, 20Y, 20C apply a two-component magnetic brush developing system. The intermediate transfer belt 22, which is a belt element, is present between each of the photoconductors 21BK, 21M, 21Y, 21C and each of the primary transfer bias rollers 23BK, 23M, 23Y, 23C, and the toner image of each color formed on a respective photoconductor is successively superimposed and transferred.

Meanwhile, the transfer paper P is borne with the transfer conveying belt 50, which is a belt component, via the registration rollers 16, after fed from a paper feeding unit 14. At the position where the intermediate transfer belt 22 is in contact with the transfer conveying belt 50, the toner images transferred onto the intermediate transfer belt 22 are secondary transferred (correctively transferred) to the transfer paper P by a secondary transfer bias roller 60 serving as the secondary transferring unit. In the manner as mentioned above, a color image is formed on the transfer paper P. The transfer paper P on which the color image has been formed is transported to the fixing device 15 by the transfer conveying belt 50, and the transferred image is fixed by the fixing device 15, followed by discharging the transfer paper P from the printer main body.

Note that, the residual toner remained on the intermediate transfer belt 22 without being transferred at the time of the secondary transfer is removed from the intermediate transfer belt 22 by the belt cleaning member 25. At the downstream side of the belt cleaning member 25, a lubricant applying device 27 is provided. The lubricant coating device 27 contains a solid lubricant, and an electric conductive brush configured to apply the solid lubricant by rubbing the solid lubricant with the intermediate transfer belt 22. The electric conductive brush is always in contact with the intermediate transfer belt 22 to apply the solid lubricant to the intermediate transfer belt 22. The solid lubricant has functions of enhancing cleaning ability of the intermediate transfer belt 22, and preventing occurrences of filming to improve the durability In FIG. 5, the numeral reference 26 denotes a belt driven roller, and the numeral reference 40 denotes a bias roller.

EXAMPLES

The present invention will be specifically explained through Examples and Comparative Examples, but Examples shall not be construed as to limit the scope of the present invention.

(Viscosity)

A viscosity of a polyimide precursor solution was measured by means of RheoStress 600 of HAAKE. Specifically, a titanium cone sensor (angle: 1°) having the diameter of 35 mm was used, and the viscosity of the solution was measured after rotating the cone sensor filled with the solution at 1 rpm for 60 seconds at 25° C.

The curling amount and micro rubber hardness of the intermediate transfer belt of Example were measured in the following manners.

(Curling Amount of Intermediate Transfer Belt)

The curling amount of the intermediate transfer belt was determined by using a sample, which had been cut out to the size of 10 cm×10 cm, and measuring the portion at which the sample was most curled. Note that, for the measurement of the curling amount, outer curl (the curl of a laminate of the base layer and the elastic layer to the side of the elastic layer) was determined as plus in value, and inner curl (the curl of a laminate of the base layer and the elastic layer to the side of the base layer) was determined as minus in value.

(Micro Rubber Hardness)

The micro rubber hardness was measured by means of a micro rubber hardness tester (MD-1, manufactured by KOBUNSHI KEIKI CO., LTD.) in the environment of 25° C., 50% RH.

Example 1

Production of Seamless Belt A

<<Preparation of Polyimide Precursor Solution A>>

Polyimide Precursor Solution A having a solid content of 18% by mass was prepared by polymerizing pyromellitic dianhydride (PMDA) with 4,4'-diaminodiphenyl ether (DDE) at a molar ratio (PMDA:DDE) of 1.0:1.0, in N-methyl-2-pyrrolidone (NMP).

The viscosity of Polyimide Precursor Solution A (NMP solution) having the solid content of 18% by mass was 6.2 Pa·s.

<<Preparations of Carbon Black Dispersion Liquid A, and Base Layer Coating Liquid A>>

A solution prepared by mixing Special Black 4 of Evonik Degussa Japan Co., Ltd., Polyimide Precursor Solution A, and NMP at the ratio (mass ratio) Special Black 4:Polyimide Precursor Solution A:NMP of 12:13:75 was dispersed by means of a ball mill packed with a 1 mm-diameter zirconia media for 12 hours, to thereby prepare Carbon Black Dispersion Liquid A.

Thereafter, Carbon Black Dispersion Liquid A and Polyimide Precursor Solution A were mixed together in the manner that the proportion of the carbon black was to be 17.5% by mass relative to the solid content, and the resulting mixture was sufficiently stirred, and degassed, to thereby prepare Base Layer Coating Liquid A.

<<Production of Polyimide Base Layer Belt A>>

A metal cylinder having an outer diameter of 375 mm, a peripheral length of 1,178 mm, and a length of 360 mm, whose outer surface had been roughened by a blast treatment, was used as a mold. While rotating this cylinder at 50 rpm (rotation/minute), Base Layer Coating Liquid A was applied by a dispenser so as to uniformly flow cast on the outer surface of the cylinder. At the timing when the predetermined total amount of the coating liquid was flown, and the coating film was uniformly spread, the rotational speed was increased to 100 rpm, and a hot air circulating dryer was introduced to gradually increase the temperature to 120° C., and heated the coating film at 120° C. for 60 minutes. The temperature was further increased to 200° C. to perform heating for 20, followed by stopping the rotation. The film was gradually cooled, and the cylinder mold was removed from the formed film. The resulting film was placed in a heating furnace (baking furnace) capable of performing a high temperature treatment, and the temperature was increased to 320° C. stepwise, and the film was subjected to a heating treatment (baking) at 320° C. for 60 minutes, to thereby obtain Polyimide Base Layer Belt A having the average thickness of 60 μm.

<<Elastic Layer Coating Liquid>>

The following materials were mixed and sufficiently kneaded by means of a two-axial kneader. The resulting kneaded product was dissolved in a solvent, to thereby prepare an elastic layer coating liquid.

| | |
|---|---|
| Acrylonitrile butadiene rubber (NBR), Nipol DN003 (of ZEON CORPORATION) | 100 parts by mass |
| Carbon black MA77 (of Mitsubishi Chemical Corporation) | 4 parts by mass |
| Zinc oxide, Pazet CK (of Hakusuitech Ltd.) | 3 parts by mass |
| Sulfur, Sulfax PS (of Tsurumi Chemical Co.) | 1 part by mass |
| 2-Heptanone (for dissolving, and product of Kyowa Hakko Chemical Co., Ltd.) | 200 parts by mass |

<<Production of Seamless Belt A>>

While rotating the mold (the metal cylinder), the elastic layer coating liquid was applied onto Polyimide Base Layer Belt A by a dispenser to uniformly flow cast the elastic layer coating liquid thereon. As for the applied amount, the amount of the coating liquid was adjusted so that the average thickness of the final elastic layer was to be 500 μm. Thereafter, the mold was placed in a hot air circulating dryer while rotating the mold, and the temperature was increased to 90° C. at the heating rate of 4° C./min, to thereby perform heating at 90° C. for 30 minutes. Subsequently, the temperature was increased to 150° C. at the heating rate of 4° C./min, to perform heating at 150° C. for 60 minutes, to thereby obtain Seamless Belt A.

Seamless Belt A had the curling amount of +0.58 mm, and the micro rubber hardness of 43°.

Note that, the micro rubber hardness of the elastic layer (average thickness: 500 μm) alone was 32°.

<Evaluation> to Seamless Belt A was mounted in the electrophotographic device illustrated in FIG. 4, and evaluated in the following manners.

<<Evaluation of Initial Image>>

As transfer paper, paper whose surface had been processed to have irregularities (Lezac 66, 175 kg paper) was used. The device was operated to output a blue solid image to the aforementioned transfer paper. The output solid image was observed, and evaluated based on the following evaluation criteria. The results are presented in Table 1.

A: The uniform density throughout the solid image.

B: The density on the concave parts of the paper was slightly thin but acceptable level.

C: The density on the concave parts of the paper was too thin to use.

<<Service Durability Evaluation>>

After continuously outputting 10,000 sheets on each of which a test chart had been printed, a cyan single color half tone image formed on the entire area of each sheet of Lezac paper having a ream weight of 215 kg, and output. During this continuous output (output of a half tone image), paper jamming caused by the curled belt, and the density unevenness formed in the edge and center parts were confirmed, and evaluated based on the following evaluation criteria. The results are presented in Table 1.

[Paper Jamming]

I: No paper jamming was caused by the curled belt.

II: The paper jamming caused by the curled belt was occurred at least once.

[Density Unevenness]

I: No density unevenness was not formed in the edge and center parts of the image.

II: Unevenness was formed in the density of the image in the edge and center parts.

Example 2

Production of Seamless Belt B

<<Preparation of Polyimide Precursor Solution B>>

Polyimide Precursor Solution B having a solid content of 18% by mass was prepared by polymerizing 4,4'-oxydiphthalic dianhydride (ODPA), pyromellitic dianhydride (PMDA), and 4,4'-diaminodiphenyl ether (DDE) at the molar ratio (ODPA:PMDA:DDE) of 0.8:0.2:1.0 in N-methyl-2-pyrrolidone (NMP).

Polyimide Precursor Solution B (NMP solution) having the solid content of 18% by mass had the viscosity of 24.5 Pa·s.

<<Production of Seamless Belt B>>

Seamless Belt B was produced in the same manner as in Example 1, provided that Polyimide Precursor Solution A was replaced with Polyimide Precursor Solution B.

Seamless Belt B had the curling amount of +0.47 mm, and the micro rubber hardness of 42°.

The evaluation was performed on Seamless Belt B in the same manner as in Example 1. The results are presented in Table 1.

Example 3

Production of Seamless Belt C

<<Preparation of Polyimide Precursor Solution C>>

Polyimide Precursor Solution C having a solid content of 18% by mass was prepared by polymerizing 3,3',4,4'-biphenyltetracarboxylic dianhydride (BPDA), pyromellitic dianhydride (PMDA), and 4,4'-diaminodiphenyl ether (DDE) at the molar ratio (BPDA:PMDA:DDE) of 0.7:0.3:1.0 in N-methyl-2-pyrrolidone (NMP).

Polyimide Precursor Solution C(NMP solution) having the solid content of 18% by mass had the viscosity of 15.4 Pa·s.

<<Production of Seamless Belt C>>

Seamless Belt C was produced in the same manner as in Example 1, provided that Polyimide Precursor Solution A was replaced with Polyimide Precursor Solution C.

Seamless Belt C had the curling amount of +0.38 mm, and the micro rubber hardness of 43°.

The evaluation was performed on Seamless Belt C in the same manner as in Example 1. The results are presented in Table 1.

Example 4

Production of Seamless Belt D

Seamless Belt D was produced in the same manner as in Example 1, provided that the average thickness of the polyimide base layer belt was changed to 130 μm.

Seamless Belt D had the curling amount of −0.82 mm, and the micro rubber hardness of 43°.

The evaluation was performed on Seamless Belt D in the same manner as in Example 1. The results are presented in Table 1.

Example 5

Production of Seamless Belt E

Seamless Belt E was produced in the same manner as in Example 1, provided that the average thickness of the elastic layer was changed to 1,500 μm.

Seamless Belt E had the curling amount of +0.94 mm, and the micro rubber hardness of 25°.

The evaluation was performed on Seamless Belt E in the same manner as in Example 1. The results are presented in Table 1.

Example 6

Production of Seamless Belt F

Seamless Belt F was produced in the same manner as in Example 1, provided that the average thickness of the polyimide base layer belt was changed to 35 μm.

Seamless Belt F had the curling amount of +0.97 mm, and the micro rubber hardness of 43°.

The evaluation was performed on Seamless Belt F in the same manner as in Example 1. The results are presented in Table 1.

Example 7

Production of Seamless Belt G

Seamless Belt G was produced in the same manner as in Example 1, provided that the average thickness of the elastic layer was changed to 190 μm.

Seamless Belt G had the curling amount of −0.91 mm, and the micro rubber hardness of 62°.

The evaluation was performed on Seamless Belt G in the same manner as in Example 1. The results are presented in Table 1.

Comparative Example 1

Production of Seamless Belt H

<<Preparation of Polyimide Precursor Solution H>>

Polyimide Precursor Solution H having a solid content of 18% by mass was prepared by polymerizing 3,3',4,4'-biphenyltetracarboxylic dianhydride (BPDA) and p-phenylene diamine (PDA) at the molar ratio (BPDA:PDA) of 1.0:1.0 in N-methyl-2-pyrrolidone (NMP).

Polyimide Precursor Solution H(NMP solution) having the solid content of 18% by mass had the viscosity of 6.1 Pa·s.

<<Production of Seamless Belt H>>

Seamless Belt H was produced in the same manner as in Example 1, provided that Polyimide Precursor Solution A was replaced with Polyimide Precursor Solution H.

Seamless Belt H had the curling amount of +3.11 mm, and the micro rubber hardness of 42°.

The evaluation was performed on Seamless Belt H in the same manner as in Example 1. The results are presented in Table 1.

Comparative Example 2

Production of Seamless Belt I

<<Preparation of Polyimide Precursor Solution I>>

Polyimide Precursor Solution I having a solid content of 18% by mass was prepared by polymerizing 3,3',4,4'-biphenyltetracarboxylic dianhydride (BPDA), 4,4'-diaminodiphenyl ether (DDE), and p-phenylene diamine (PDA) at the molar ratio (BPDA:DDE:PDA) of 1.0:0.5:0.5 in N-methyl-2-pyrrolidone (NMP).

Polyimide Precursor Solution I (NMP solution) having the solid content of 18% by mass had the viscosity of 6.5 Pa·s.

<<Production of Seamless Belt I>>

Seamless Belt I was produced in the same manner as in Example 1, provided that Polyimide Precursor Solution A was replaced with Polyimide Precursor Solution I.

Seamless Belt I had the curling amount of +3.87 mm, and the micro rubber hardness of 42°.

The evaluation was performed on Seamless Belt I in the same manner as in Example 1. The results are presented in Table 1.

Example 8

Production of Seamless Belt J

To Polyimide Base Layer Belt A prepared in Example 1, the elastic layer coating liquid prepared in Example 1 was applied by a dispenser to thereby uniformly flow cast the elastic layer coating liquid on the outer surface of Polyimide Base Layer Belt A, while rotating the mold. The applied amount of the coating liquid was adjusted so that the average thickness of the final elastic layer was to be 500 μm. Thereafter, the mold was placed in a hot air circulating dryer while continuously rotating the mold, and the temperature was increased to 90° C. at the heating rate of 4° C./min to perform heating for 30 minutes. The mold was then removed from the dryer, and cooled to room temperature, followed by uniformly spreading silicone spherical particles "TOSPEARL 120" (the volume average particle diameter of 2.0 μm, manufactured by Momentive Performance Materials Inc.) over the surface of the elastic layer. The silicone spherical particles were fixed in the elastic layer by pressing a pressing member of a polyurethane rubber blade using the device of FIG. 3. Thereafter, the resultant was heated at 150° C. for 60 minutes to thereby form a particle layer formed by aligning the spherical particles on the elastic layer along the plane direction to give a convexoconcave surface configuration. As a result, Seamless Belt J was obtained. Seamless Belt J had the curling amount of +0.55 mm, and the micro rubber hardness of 44°.

The evaluation was performed on Seamless Belt J in the same manner as in Example 1. The results are presented in Table 1.

Comparative Example 3

Production of Seamless Belt K

Seamless Belt K was produced in the same manner as in Example 1, provided that the average thickness of the elastic layer was changed to 2,200 μm.

Seamless Belt K had the curling amount of +1.74 mm, and the micro rubber hardness of 21°. The evaluation was performed on Seamless Belt K in the same manner as in Example 1. The results are presented in Table 1.

Example 9

Seamless Belt L was produced in the same manner as in Example 1, provided that the elastic layer coating liquid was replaced with the following elastic layer coating liquid.

<<Elastic Layer Coating Liquid>>

| | |
|---|---|
| Acrylic rubber (Nipol AR12, manufactured by ZEON CORPORATION) | 100 parts by mass |
| Stearic acid (Beads, Stearic Acid TSUBAKI, manufactured by NOF Corporation) | 1 part by mass |

-continued

| | |
|---|---|
| Red phosphorus (Nove Excel (RINKA FE) 140F, manufactured by Rinkagaku Kogyo Co., Ltd.) | 10 parts by mass |
| Aluminum hydroxide (HIGILITE H42M, manufactured by Showa Denko K.K.) | 50 parts by mass |
| Crosslinking agent (Diak No. 1 (hexamethylene diamine carbamate), manufactured by DuPont Dow Elastomers Japan) | 0.6 parts by mass |
| Crosslink accelerator (VULCOFAC ACT55 (70% by mass of a salt of 1,8-diazabicyclo(5,4,0)undec-7-ene and dibasic acid, 30% by mass of amorphous silica), manufactured by Safic-Alcan) | 0.6 parts by mass |
| Nitrile rubber (rubber copolymer of acrylonitrile and butadiene)(Nipol 1042 manufactured by ZEON CORPORATION) | 10 parts by mass |
| Sulfur (200-mesh sulfur, manufactured by Tsurumi Chemical Co., Ltd.) | 0.1 parts by mass |
| Zinc oxide (secondary (graded in accordance with JIS) zinc white, manufactured by Seido Chemical Industries Co., Ltd.) | 0.3 parts by mass |
| Vulcanization accelerator (Nocceller CZ, manufactured by Ouchi Shinko Chemical Industrial Co., Ltd.) | 0.1 parts by mass |
| Electric conductant agent (QAP-01 (tetrabutylammonium perchlorate), manufactured by Japan Carlit Co., Ltd.) | 0.3 parts by mass |

Seamless Belt L had the curling amount of +1.36 mm, and the micro rubber hardness of 43°. The evaluation was performed on Seamless Belt L in the same manner as in Example 1. The results are presented in Table 1.

Note that the micro rubber hardness of the elastic layer (the average thickness: 500 μm) alone was 33°.

Example 10

Polyimide Precursor Solution M having a solid content of 18% by mass was prepared in the same manner as in Example 1, provided that in the preparation of the polyimide precursor solution, 4,4'-diaminodiphenyl ether (DDE) serving as diamine was replaced with 3,4'-diaminodiphenyl ether.

Polyimide Precursor Solution M (NMP solution) having the solid content of 18% by mass had the viscosity of 6.9 Pa·s.

Seamless Belt M was produced in the same manner as in Example 1, provided that Polyimide Precursor Solution A was replaced with Polyimide Precursor Solution M.

Seamless Belt M had the curling amount of +0.77 mm, and the micro rubber hardness of 43°. The evaluation was performed on Seamless Belt M in the same manner as in Example 1. The results are presented in Table 1.

Example 11

Polyimide Precursor Solution N having a solid content of 18% by mass was prepared in the same manner as in Example 1, provided that in the preparation of the polyimide precursor solution, 4,4'-diaminodiphenyl ether (DDE) serving as diamine was replaced with 4,4'-diaminodiphenyl ether (DDE) and m-phenylene diamine (m-PDA), and the molar ratio PMDA:DDE:m-PDA was changed to 1.0:0.6:0.4.

Polyimide Precursor Solution N(NMP solution) having the solid content of 18% by mass had the viscosity of 12.4 Pa·s.

Seamless Belt N was produced in the same manner as in Example 1, provided that Polyimide Precursor Solution A was replaced with Polyimide Precursor Solution N.

Seamless Belt N had the curling amount of +0.88 mm, and the micro rubber hardness of 43°. The evaluation was performed on Seamless Belt N in the same manner as in Example 1. The results are presented in Table 1.

Example 12

Production of Seamless Belt O

<<Preparation of Polyimide Precursor Solution O>>

Polyimide Precursor Solution O having a solid content of 18% by mass was prepared by polymerizing 3,3',4,4'-biphenyltetracarboxylic dianhydride (BPDA), pyromellitic dianhydride (PMDA), and 4,4'-diaminodiphenyl ether(DDE) at the molar ratio (BPDA:PMDA:DDE) of 0.3:0.7:1.0 in N-methyl-2-pyrrolidone (NMP).

Polyimide Precursor Solution O (NMP solution) having the solid content of 18% by mass had the viscosity of 16.2 Pa·s.

<<Production of Seamless Belt O>>

Seamless Belt O was produced in the same manner as in Example 1, provided that Polyimide Precursor Solution A was replaced with Polyimide Precursor Solution O.

Seamless Belt O had the curling amount of +0.29 mm, and the micro rubber hardness of 43°. The evaluation was performed on Seamless Belt O in the same manner as in Example 1. The results are presented in Table 1.

Note that, the cleaning failure means a failure caused by residues of the toner, external additives, or paper powder, when the output image is an image with a defect, which can be confirmed by observing the seamless belt.

In Examples 3 and 12, in both of which the amount of the constitutional unit derived from pyromellitic acid in polyimide was 0.3 to 0.7 in the molar ratio (the constitutional unit derived from pyromellitic acid/the total amount of the constitutional units derived from polycarboxylic acid), an excellent seamless belt with a very small curling amount could be attained.

The embodiments of the present invention are as follows:

<1> An intermediate transfer belt, containing:

a base layer; and an elastic layer formed on the base layer, wherein the base layer contains polyimide which has a constitutional unit derived from pyromellitic acid and a constitutional unit derived from diaminodiphenyl ether, wherein the intermediate layer has a curling amount of 1.5 mm or less in an absolute value, and

TABLE 1

| | Belt | Average thickness of polyimide base layer belt (μm) | Average thickness of elastic layer (μm) | curling amount (mm) | Micro rubber hardness | Initial image Evaluation | Service durability Paper jamming | Service durability Uneven image | Notes |
|---|---|---|---|---|---|---|---|---|---|
| Ex. 1 | A | 60 | 500 | 0.58 | 43° | A | I | I | |
| Ex. 2 | B | 60 | 500 | 0.47 | 42° | A | I | I | |
| Ex. 3 | C | 60 | 500 | 0.38 | 43° | A | I | I | |
| Ex. 4 | D | 130 | 500 | −0.82 | 43° | A | I | I | |
| Ex. 5 | E | 60 | 1,500 | 0.94 | 25° | A | I | I | |
| Ex. 6 | F | 35 | 500 | 0.97 | 43° | A | I | I | |
| Ex. 7 | G | 60 | 190 | −0.91 | 62° | B | I | I | White spot was partially formed on the concave part |
| Comp. Ex. 1 | H | 60 | 500 | 3.11 | 42° | A | II | II | Cleaning failure occurred partially |
| Comp. Ex. 2 | I | 60 | 500 | 3.87 | 42° | A | II | II | Cleaning failure occurred partially |
| Ex. 8 | J | 60 | 500 | 0.55 | 44° | A | I | I | |
| Comp. Ex. 3 | K | 60 | 2,200 | 1.74 | 21° | A | II | II | Large number of running failures, and uneven density in the image occurred |
| Ex. 9 | L | 60 | 500 | 1.36 | 43° | A | I | I | |
| Ex. 10 | M | 60 | 500 | 0.77 | 43° | A | I | I | |
| Ex. 11 | N | 60 | 500 | 0.88 | 43° | A | I | I | |
| Ex. 12 | O | 60 | 500 | 0.29 | 43° | A | I | I | |

As depicted in the column of "Notes" in Table 1, any cleaning failure did not occur in Examples 1 to 12 of the present invention, though a cleaning failure partially occurred in Comparative Examples 1 to 3.

wherein the intermediate transfer belt is configured to receive, by transferring, a toner image formed by developing, with a toner, a latent image formed on an image bearing member.

<2> The intermediate transfer belt according to <1>, wherein the elastic layer has the average thickness of 400 μm to 1,500 μm.

<3> The intermediate transfer belt according to any of <1> or <2>, wherein the intermediate transfer belt is an endless belt, and has a peripheral length of 1,000 mm or greater.

<4> The intermediate transfer belt according to any one of <1> to <3>, wherein an amount of the constitutional unit derived from pyromellitic acid in the polyimide is determined as a molar ratio of the constitutional unit derived from pyromellitic acid to a total amount of constitutional unit derived from polycarboxylic acid in the polyimide, and the molar ratio is 0.3 to 0.7.

<5> The intermediate transfer belt according to any one of <1> to <4>, wherein the base layer has the average thickness of 40 μm to 120 μm.

<6> The intermediate transfer belt according to any one of <1> to <5>, wherein the elastic layer has spherical particles aligned on a surface thereof along a planar direction, and has a convexoconcave surface configuration.

<7> The intermediate transfer belt according to any one of <1> to <6>, wherein the intermediate transfer belt has micro rubber hardness of 60° or lower.

<8> An image forming apparatus, containing:

an image bearing member configured to form a latent image thereon and bear a toner image;

a developing unit configured to develop, with a toner, the latent image formed on the image bearing member to thereby form a toner image;

an intermediate transfer belt to which the toner image developed by the developing unit is primary transferred; and a transferring unit configured to secondary transfer the toner image borne on the intermediate transfer belt onto a recording medium, wherein the intermediate transfer belt is the intermediate transfer belt as defined in any one of <1> to <7>.

<9> The image forming apparatus according to <8>, wherein the image forming apparatus is a full-color image forming apparatus, and wherein the image forming apparatus contains a plurality of the image bearing members, where the image bearing members are tandemly aligned, and each have the developing unit of a respective color.

This application claims priority to Japanese application No. 2011-147241, filed on Jul. 1, 2011, and Japanese application No. 2012-105331, filed on May 2, 2012, which are incorporated herein by reference.

What is claimed is:

1. An intermediate transfer belt, comprising:

a base layer; and an elastic layer formed on the base layer, wherein the base layer contains polyimide which has a constitutional unit derived from pyromellitic acid and a constitutional unit derived from diaminodiphenyl ether, wherein the intermediate transfer belt has a curling amount of 1.5 mm or less in an absolute value, and wherein the intermediate transfer belt is configured to receive, by transferring, a toner image formed by developing, with a toner, a latent image formed on an image bearing member.

2. The intermediate transfer belt according to claim 1, wherein the elastic layer has the average thickness of 400 μm to 1,500 μm.

3. The intermediate transfer belt according to claim 1, wherein the intermediate transfer belt is an endless belt, and has a peripheral length of 1,000 mm or greater.

4. The intermediate transfer belt according to claim 1, wherein an amount of the constitutional unit derived from pyromellitic acid in the polyimide is determined as a molar ratio of the constitutional unit derived from pyromellitic acid to a total amount of constitutional unit derived from polycarboxylic acid in the polyimide, and the molar ratio is 0.3 to 0.7.

5. The intermediate transfer belt according to claim 1, wherein the base layer has the average thickness of 40 μm to 120 μm.

6. The intermediate transfer belt according to claim 1, wherein the elastic layer has spherical particles aligned on a surface thereof along a planar direction, and has a convexoconcave surface configuration.

7. The intermediate transfer belt according to claim 1, wherein the intermediate transfer belt has micro rubber hardness of 60° or lower.

8. An image forming apparatus, comprising:

an image bearing member configured to form a latent image thereon and bear a toner image;

a developing unit configured to develop, with a toner, the latent image formed on the image bearing member to thereby form a toner image;

an intermediate transfer belt to which the toner image developed by the developing unit is primary transferred; and a transferring unit configured to secondary transfer the toner image borne on the intermediate transfer belt onto a recording medium, wherein the intermediate transfer belt contains:

a base layer; and an elastic layer formed on the base layer, wherein the base layer contains polyimide which has a constitutional unit derived from pyromellitic acid and a constitutional unit derived from diaminodiphenyl ether, and wherein the intermediate transfer belt has a curling amount of 1.5 mm or less in an absolute value.

9. The image forming apparatus according to claim 8, wherein the elastic layer has the average thickness of 400 μm to 1,500 μm.

10. The image forming apparatus according to claim 8, wherein the intermediate transfer belt is an endless belt, and has a peripheral length of 1,000 mm or greater.

11. The image forming apparatus according to claim 8, wherein an amount of the constitutional unit derived from pyromellitic acid in the polyimide is determined as a molar ratio of the constitutional unit derived from pyromellitic acid to a total amount of constitutional unit derived from polycarboxylic acid in the polyimide, and the molar ratio is 0.3 to 0.7.

12. The image forming apparatus according to claim 8, wherein the base layer has the average thickness of 40 μm to 120 μm.

13. The image forming apparatus according to claim 8, wherein the elastic layer has spherical particles aligned on a surface thereof along a planar direction, and has a convexoconcave surface configuration.

14. The image forming apparatus according to claim 8, wherein the intermediate transfer belt has micro rubber hardness of 60° or lower.

15. The image forming apparatus according to claim 8, wherein the image forming apparatus is a full-color image forming apparatus, and wherein the image forming apparatus contains a plurality of the image bearing members, where the image bearing members are tandemly aligned, and each have the developing unit of a respective color.

* * * * *